US009403262B2

(12) United States Patent
Albin

(10) Patent No.: US 9,403,262 B2
(45) Date of Patent: Aug. 2, 2016

(54) HANDTIGHT CLAMP

(71) Applicant: Stephen D. Albin, Los Altos, CA (US)

(72) Inventor: Stephen D. Albin, Los Altos, CA (US)

( * ) Notice: Subject to any disclaimer, the term of this patent is extended or adjusted under 35 U.S.C. 154(b) by 128 days.

(21) Appl. No.: 14/206,998

(22) Filed: Mar. 12, 2014

(65) Prior Publication Data

US 2014/0265086 A1 Sep. 18, 2014

Related U.S. Application Data

(60) Provisional application No. 61/785,120, filed on Mar. 14, 2013.

(51) Int. Cl.
*B25B 1/00* (2006.01)
*B25B 5/06* (2006.01)

(52) U.S. Cl.
CPC ..... *B25B 5/068* (2013.01)

(58) Field of Classification Search
USPC ..... 269/3, 6, 166, 285, 286
See application file for complete search history.

(56) References Cited

U.S. PATENT DOCUMENTS 4,202,540 A * 5/1980 Neff ..... B25B 5/02 269/166
4,555,100 A * 11/1985 Ditto ..... B25B 5/166 269/166
5,975,483 A * 11/1999 Schule ..... E04G 17/045 249/192
6,896,232 B2 * 5/2005 Crowell ..... B25B 5/06 248/229.12
7,686,267 B2 * 3/2010 DaSilva ..... A61B 17/02 248/228.5

* cited by examiner

*Primary Examiner* — Joseph J Hail
*Assistant Examiner* — Shantese McDonald
(74) *Attorney, Agent, or Firm* — Beyer Law Group LLP

(57) ABSTRACT

A handtight clamp comprising two parallel rods that are press-fit into a stable handle and which have a moving handle that is movable across the parallel rods. The handtight clamp also comprising a first coil spring and a second coil spring around the two parallel rods, the first coil spring having less bearing pressure than the second coil spring, and the first coil spring laying adjacent to the moving handle. The handtight clamp additionally comprising a jaw extending from the stable handle and the moving handle, the jaw having a rigid inner jaw portion and a semi-rigid outer jaw portion.

16 Claims, 8 Drawing Sheets

HANDTIGHT CLAMP

CROSS-REFERENCE TO RELATED APPLICATIONS

This application claims benefit to U.S. Provisional Patent Application No. 61/785,120 filed on Mar. 14, 2013, entitled "HANDTIGHT CLAMP," which is incorporated herein by reference for all purposes.

BACKGROUND OF THE INVENTION

Field of the Invention

The present disclosure relates to clamps. In particular, the present disclosure relates to clamps that are easily readjustable.

SUMMARY OF THE INVENTION

A handtight clamp comprising two parallel rods that are press-fit into a stable handle and which have a moving handle that is movable across the parallel rods. The handtight clamp also comprises a first coil spring and a second coil spring around each of the two parallel rods, the first coil spring having less bearing pressure than the second coil spring, and the first coil spring laying adjacent to the moving handle. The handtight clamp additionally comprising a jaw extending from the stable handle and the moving handle, the jaw having a rigid inner jaw portion and a semi-rigid outer jaw portion.

These and other features of the present invention will be described in more details below in the detailed description of the invention and in conjunction with the following figures.

BRIEF DESCRIPTION OF THE DRAWINGS

The present invention is illustrated by way of example, and not by way of limitation, in the figures of the accompanying drawings and in which like reference numerals refer to similar elements and in which.

DETAILED DESCRIPTION OF THE PREFERRED EMBODIMENTS

The present disclosure will now be described in detail with reference to a few preferred embodiments thereof as illustrated in the accompanying drawings. In the following description, numerous specific details are set forth in order to provide a thorough understanding of the present invention. It will be apparent, however, to one skilled in the art, that the present invention may be practiced without some or all of these specific details. In other instances, well known process steps and/or structures have not been described in detail in order to not unnecessarily obscure the present invention.

The handtight clamp discussed herein allows a user to control the amount of pressure applied through the clamp by applying the pressure by moving the handles of the clamp together by directly closing his hands around the handles. As such, a user is able to better know how much pressure is being exerted so as to avoid over-tightening, which can result in cracking, or under-tightening, which can result in objects falling from the clamps. Additionally, jaws in the handtight clamp are semi-rigid so as to allow the jaws to form-fit to objects that are being clamped. Further, the hightight clamp has pressure that is applied gradually via general compaction so as to allow the handtight clamp to be readily adjusted.

Figure 1:
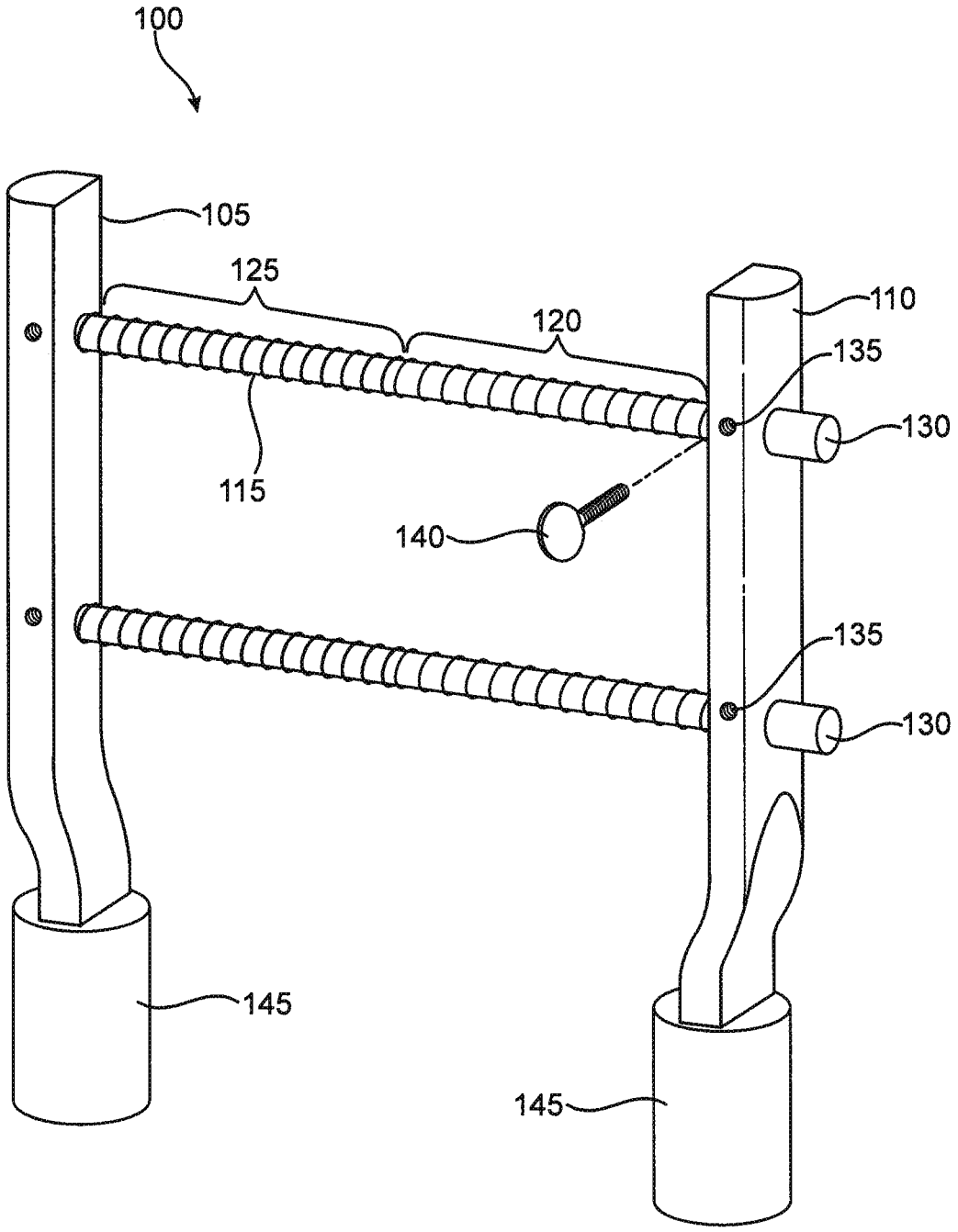
FIG. 1 illustrates a front perspective view of a handtight clamp and a securing key, in accordance with embodiments of the present invention.

FIG. 1 illustrates a front perspective view of handtight clamp 100 and threaded locking screw 140, in accordance with embodiments of the present invention. In particular, FIG. 1 includes stable handle 105, moving handle 110, parallel rods 115, first coil spring 120, second coil spring 125, caps 130, threaded holes 135, threaded locking screw 140, and outer jaw portion 145. Stable handle 105 has parallel rods 115 that are press-fit into it. As such, stable handle 105 is stationary with respect to the parallel rods 115. In contrast, moving handle 110 is able to move across parallel rods 115. In particular, as moving handle 110 moves across parallel rods 115 towards stable handle 105, moving handle 110 compresses springs 120 and 125 that are oriented between stable handle 105 and moving handle 110.

As seen in FIG. 1, first coil spring 120 is looser than second coil spring 125. This is because first coil spring 120 is easier to compress than second coil spring. For example, first coil spring 120 may be a 50 pound spring while second coil spring 125 may be a 100 pound spring. As such, when you start to compress handtight clamp 100, it requires less compression to translocate moving handle 110 across the first coil spring 120 and it is requires more compression to translocate moving handle 110 across second coil spring 125. However, as the hand closes, less leverage is required to compress handles 105 and 110 together.

Figure 2:
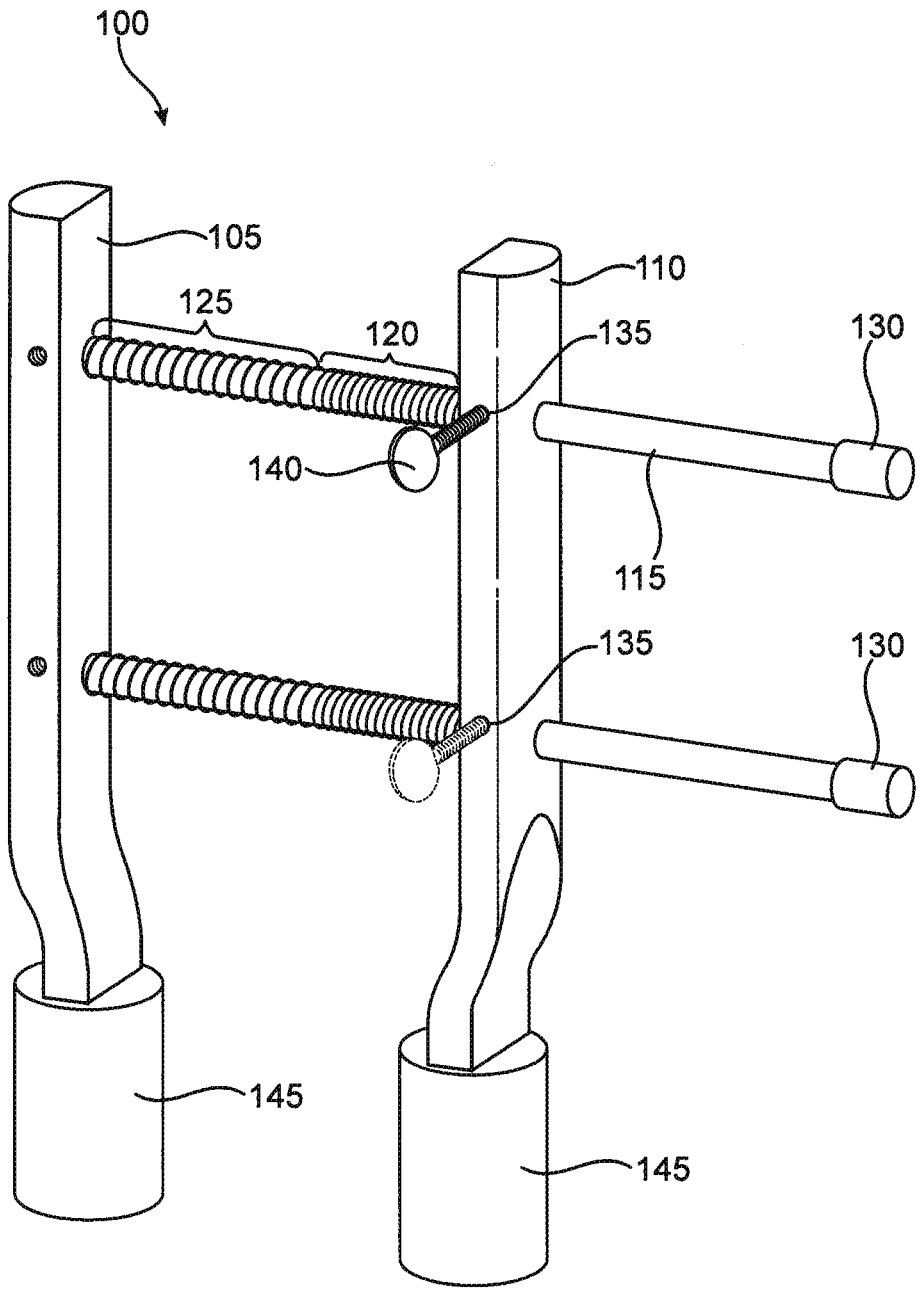
FIG. 2 illustrates a front perspective view of a compressed handtight clamp and a securing key in two locations, in accordance with embodiments of the present invention.

Accordingly, FIG. 2 illustrates a front perspective view of a compressed handtight clamp 100 of FIG. 1 and a threaded locking screw 140 in two locations, in accordance with embodiments of the present invention. In particular, FIG. 2 provides a depiction of handtight clamp 100 when it is in a compressed position. Accordingly, FIG. 2 includes stable handle 105, moving handle 110, parallel rods 115, first coil spring 120, second coil springs 125, caps 130, threaded holes 135, threaded locking screw 140, and outer jaw portion 145. In particular, when FIG. 2 is in a compressed position, threaded locking screw 140 may be secured into threaded holes 135 so as to keep moving handle 110 in a stationary position with respect to stable handle 105. Threaded locking screw 140 stabilizes moving handle 110 by providing pressure against a parallel rod 115, either on a top row, a bottom row, or both.

As seen in FIG. 2, first coil spring 120 is seen as being more compressed than second coil spring 125. First coil spring 120 is more compressed than second coil spring 125 because first coil spring 120 is compressed first. In this way, more potential energy is stocked in a compressed second coil spring 125 rather than a compressed first coil spring 120. This additional potential energy is converted to kinetic energy when pressure that is placed on moving handle 110 is released. Accordingly, the amount of kinetic energy released by compressed, or partially compressed, second coil spring 125 is designed to allow the handtight clamp to easily release an object that is being held with handtight clamp. Additionally, caps 130 are attached to parallel rods 115 so as to keep moving handle 110 from falling off of parallel rods 115. In alternative embodiments, other designs may be used to keep the moving handle from being removed from the parallel rods 115.

Figure 3:
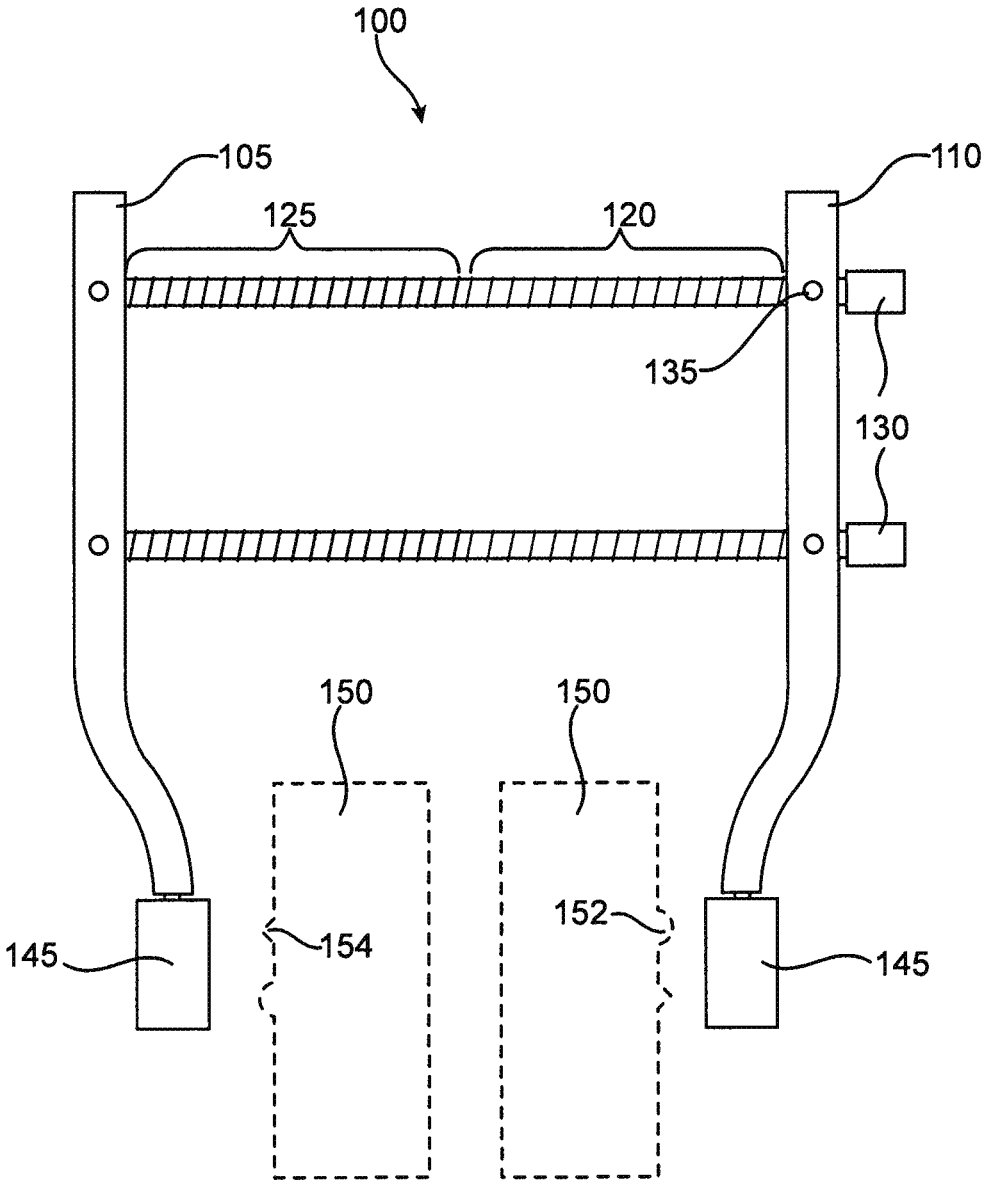
FIG. 3 illustrates a front view of a handtight clamp, in accordance with embodiments of the present invention.

FIG. 3 illustrates a front view of a handtight clamp 100 with respect to two blocks 150, in accordance with embodiments of the present invention. In particular, FIG. 3 includes stable handle 105, moving handle 110, parallel rods 115, first coil spring 120, second coil springs 125, caps 130, threaded holes 135, threaded locking screw 140, outer jaw portion 145, blocks 150, and inner jaw portion 155. Blocks 150 have features 152 and 154. In particular, blocks 150 have semicircular features 154 and triangular features 154. As shown in FIG. 3, handtight clamp 100 is positioned to engage blocks 150.

Figure 4:
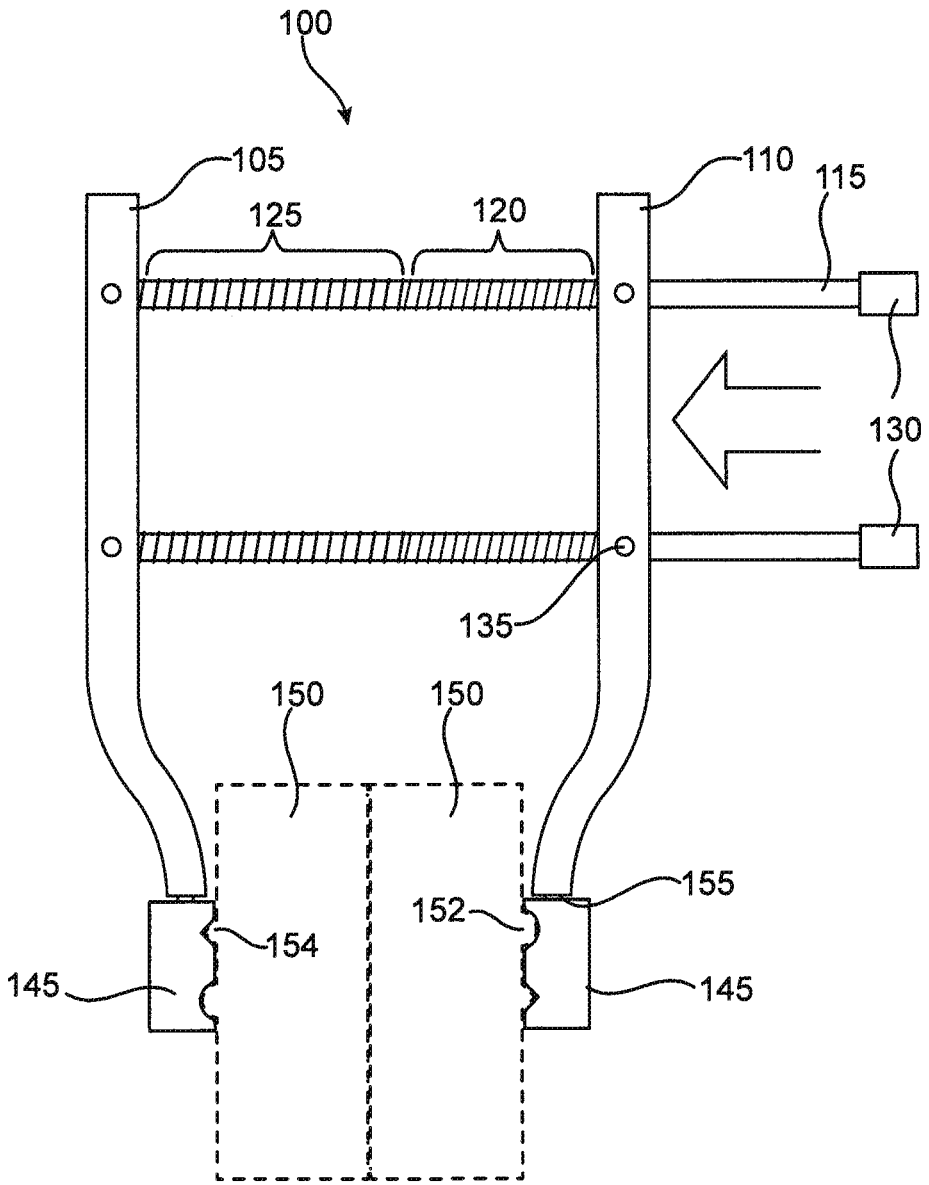
FIG. 4 illustrates a front view of a compressed handtight clamp, in accordance with embodiments of the present invention.
Figure 5:
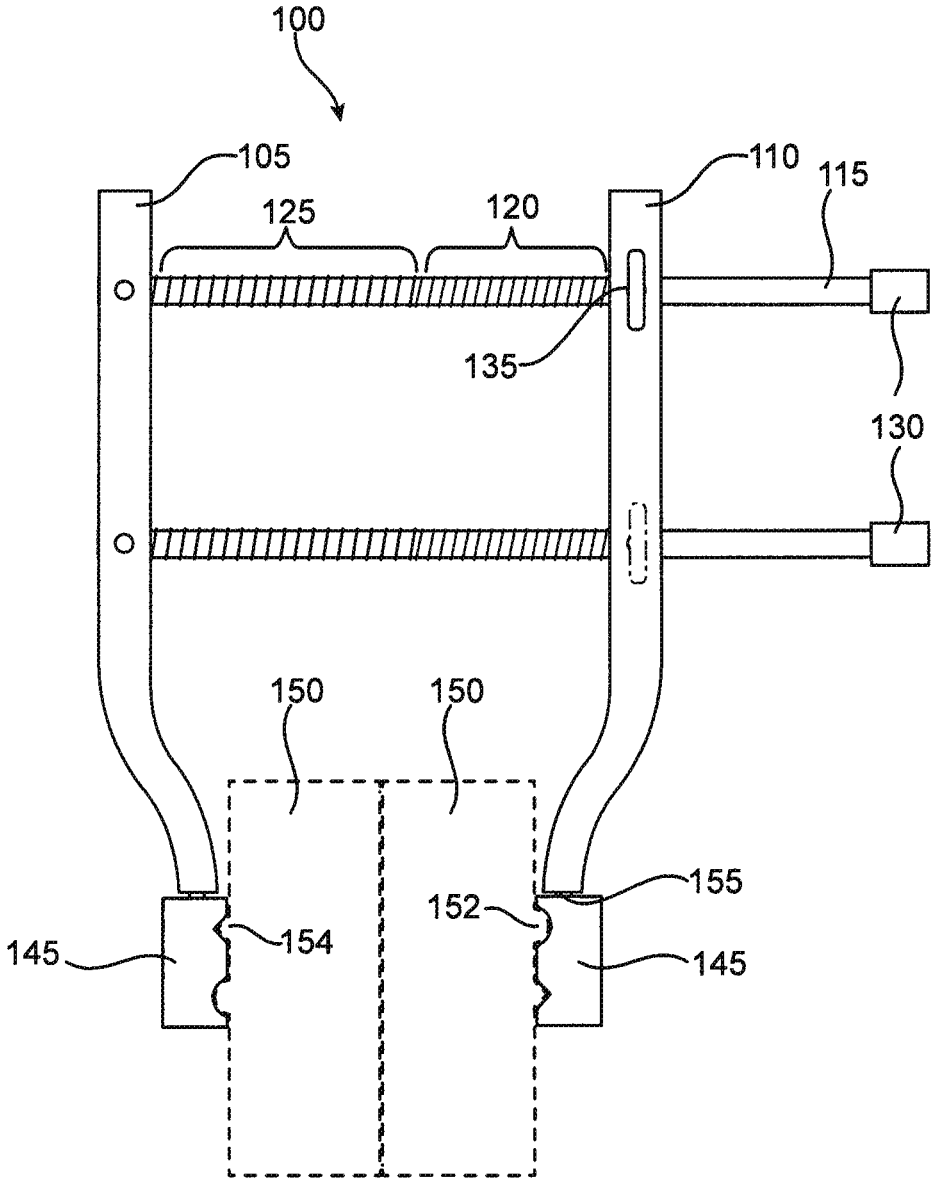
FIG. 5 illustrates a front view of a compressed handtight clamp and a locked securing key in two locations, in accordance with embodiments of the present invention.

FIG. 4 illustrates a front view of a compressed handtight clamp 100 engaging blocks 150, in accordance with embodiments of the present invention. In particular, FIG. 4 includes stable handle 105, moving handle 110, parallel rods 115, first coil spring 120, second coil springs 125, caps 130, threaded holes 135, threaded locking screw 140, outer jaw portion 145, blocks 150, and inner jaw portion 155. FIG. 5 illustrates a front view of a compressed handtight clamp of FIG. 1 and a threaded locking screw 140 in two locations, in accordance with embodiments of the present invention. As such, FIG. 5 includes stable handle 105, moving handle 110, parallel rods 115, first coil spring 120, second coil springs 125, caps 130, threaded holes 135, threaded locking screw 140, outer jaw portions 145, blocks 150 having features 152 and 154, and inner jaw portions 155. As seen in FIG. 5, the threaded locking screw 140 is in an up or "locked" position. Further, threaded locking screw may be positioned in a top threaded hole 135 or in a bottom threaded hole 135. A threaded locking screw 140 would reasonably only be locked on the moving handle 110. While a threaded locking screw 140 may possibly be placed on a threaded hole 135 on stable handle 105, this would only be needed if the pressure exerted against stable handle 105 were so great so as to overpower the press fit of parallel rods 115 into stable handle 105. Accordingly, alternative embodiments of the present invention may have the threaded holes 135 on stable handle 105 removed and still be within the disclosure of the present invention so long as there is at least one threaded hole 135 on the moving handle 110.

Figure 6:
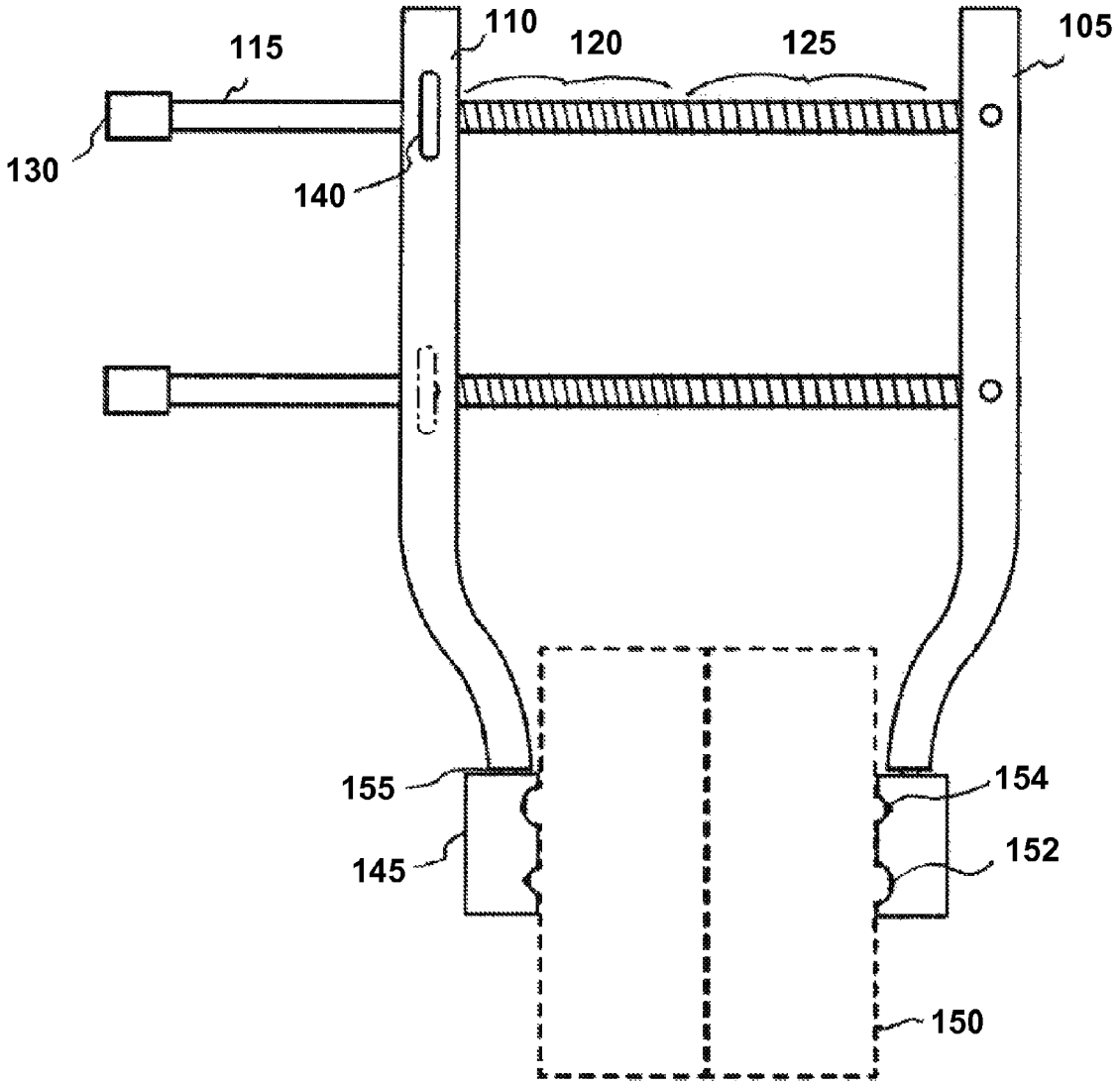
FIG. 6 illustrates a back view of a compressed handtight clamp and a locked securing key in two locations, in accordance with embodiments of the present invention.

FIG. 6 illustrates a back view of a compressed handtight clamp of FIG. 1 and a threaded locking screw 140 in two locations, in accordance with embodiments of the present invention. As such, FIG. 6 includes stable handle 105, moving handle 110, parallel rods 115, first coil spring 120, second coil springs 125, caps 130, threaded holes 135, threaded locking screw 140, outer jaw portions 145, blocks 150 having features 152 and 154, and inner jaw portions 155. As seen in FIG. 6, the threaded locking screw 140 is in an up or "locked" position.

Figure 7:
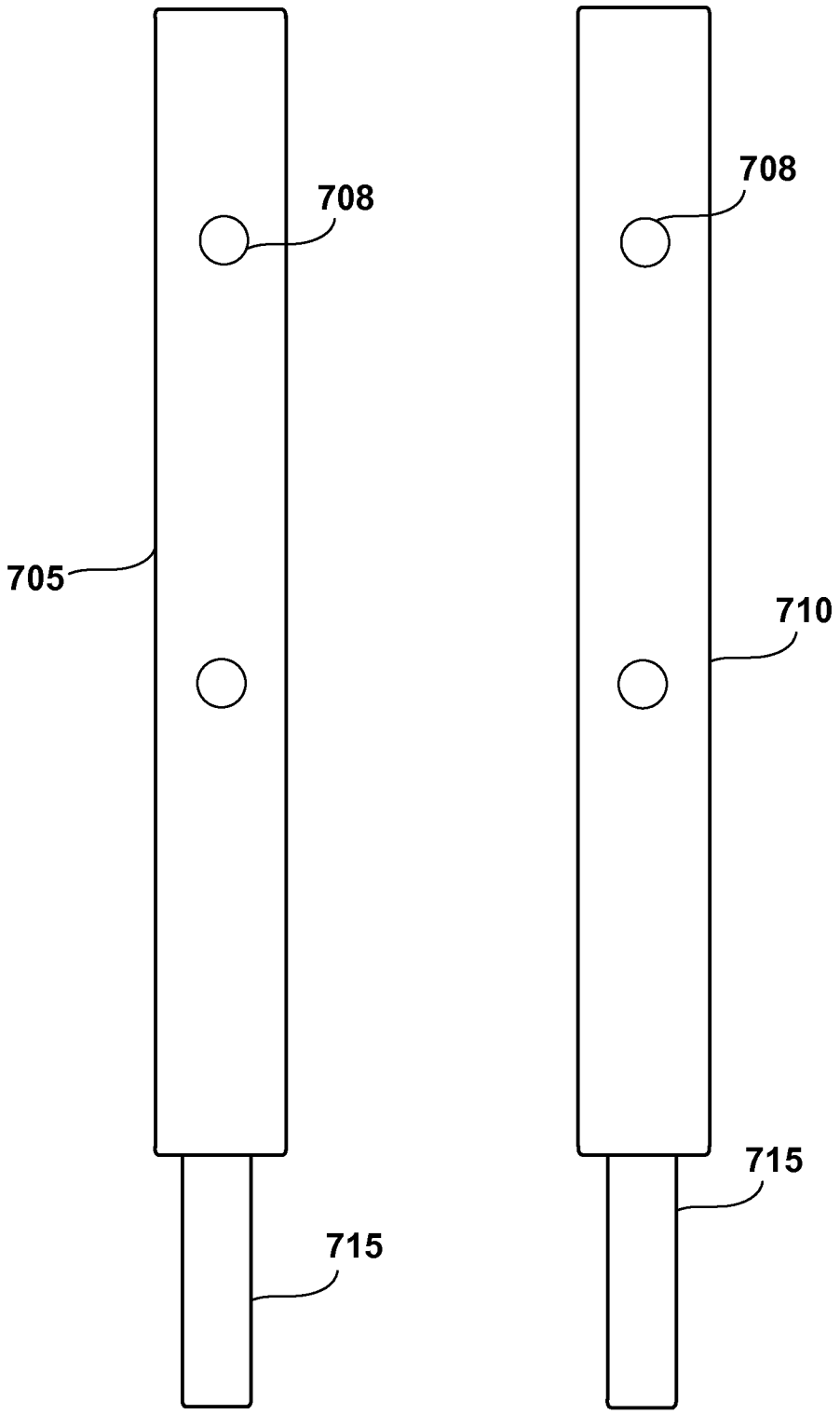
FIG. 7 illustrates a side view of a handtight clamp handles, in accordance with embodiments of the present invention.

FIG. 7 illustrates a side view of a handtight clamp handles 700 and 705, in accordance with embodiments of the present invention. In particular, FIG. 7 includes an inner side view of stable handle 705 and moving handle 710. As seen in FIG. 7, stable handle 705 and moving handle 710 have bore holes 708 through which parallel rods can pass. In particular, the bore hole 708 of stable handle 705 does not go completely through stable handle 705, whereas the bore hole 708 of moving hand 710 does go completely through so as to allow moving handle 710 to pass freely across the rods. Additionally, an inner jaw portion 715 extends from each handle 705 and 710.

Figure 8:
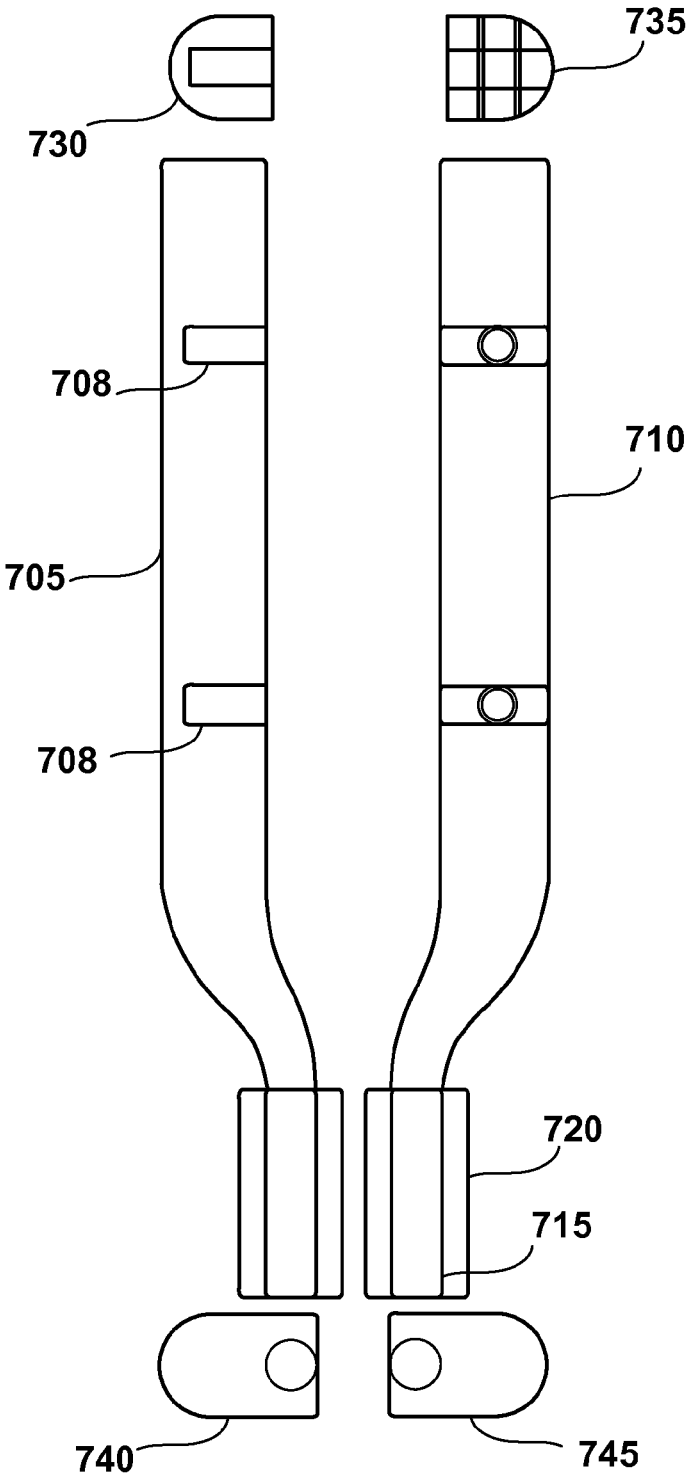
FIG. 8 illustrates a front view, top view, and bottom view of handtight clamp handles, in accordance with embodiments of the present invention.

FIG. 8 illustrates a front view, top view, and bottom view of handtight clamp handles of FIG. 7, in accordance with embodiments of the present invention. In particular, FIG. 8 includes a front view of stable handle 705 and moving handle 710. As seen in FIG. 7, an inner jaw portion 715 extends from each handle 705 and 710. Additionally, FIG. 8 includes an outline of outer jaw portion 720 as it is removably placed over inner jaw portion 715. Accordingly, FIG. 8 shows the extent that inner jaw portions 715 extend from stable handle 705 and moving handle 710. In particular, inner jaw portion 715 is made of a rigid material and outer jaw portion 720 is made of a semi-flexible material, such as foam or gel.

FIG. 8 also illustrates a top view of handles 705 and 710. In particular, FIG. 8 shows a top view 730 of stable handle 705. Top view 730 includes a bore hole 708 that does not go all the way horizontally through the handle. Instead, bore hole 708 of stable handle 705 is used to press fit a parallel rod into stable handle 705. Additionally, FIG. 8 illustrates a top view 735 of moving handle 710. In particular, top view 735 illustrates a bore hole 708 of moving handle 710 that goes all the way through horizontally so as to allow a parallel rod to pass through moving handle 710. Additionally, top view 735 also illustrates a cross-section that allows a threaded locking key 740 to apply pressure to a parallel rod, thus keeping the parallel rod in place.

FIG. 8 also illustrates a bottom view 740 of handle 705 and a bottom view 745 of handle 710. In particular, both views illustrate the view of the handles as well as the circular impression of the inner jaw portion.

While this invention has been described in terms of several preferred embodiments, there are alterations, permutations, and substitute equivalents, which fall within the scope of this invention. It should also be noted that there are many alternative ways of implementing the methods and apparatuses of the present invention. It is therefore intended that the following appended claims be interpreted as including all such alterations, permutations, and substitute equivalents as fall within the true spirit and scope of the present invention.

What is claimed is:

1. A hand operated clamp consisting essentially of:

a stable handle, the stable handle having a first grip feature at a first end of the stable handle;

a pair of parallel rods secured to and extending outward from the stable handle;

a moveable handle that is moveable along the parallel rods, the moveable handle having a second grip feature at a first end of the moveable handle, the first and second grip features being positioned opposite one another to facilitate gripping an item there between when the moveable handle is pulled towards the stable handle;

a first coil spring arrangement positioned about the first rod and arranged engage the stable and moveable handles to bias the moveable handle away from the stable handle;

a second coil spring arrangement positioned about the second rod and arranged engage the stable and moveable handles to further bias the moveable handle away from the stable handle; and a locking mechanism carried on the moveable handle and arranged to engage one of the rods when locked to hold the moveable handle in place relative to the rods; and wherein each coil spring arrangement constitutes a first coil spring and a second coil spring arranged in series about their corresponding rod.

2. A hand operated clamp as recited in claim 1 wherein:

the moving handle has at least one threaded hole, each threaded hole being positioned adjacent one of the parallel rods; and the locking mechanism is at least one threaded locking screw, each locking mechanism arranged to threadably engage a selected one of the threaded holes, and wherein a distal end of each threaded locking screw is arranged to engage the rod adjacent the selected threaded hole to provide a friction lock that holds the moveable handle in place relative to the rods when the threaded locking screw is screwed sufficiently into the first threaded hole.

3. A hand operated clamp as recited in claim 1 wherein the grip features are compressible and formed from foam.

4. A hand operated clamp as recited in claim 1 wherein the first end of each handle includes a post portion and each grip feature is carried by the post portion of the grip feature's corresponding handle.

5. A hand operated clamp as recited in claim 1 wherein the hand operated clamp is configured to be held by a user using a single hand with a thumb engaging one of the handles and one or more fingers engaging the other handle to facilitate use, whereby the moveable handle can be drawn towards the stable handle by pulling the thumb and fingers together thereby facilitate clamping an object between the first and second grip features.

6. A hand operated clamp as recited in claim 1 wherein the first coil spring has a higher spring constant than the second coil spring.

7. A hand operated clamp as recited in claim 1 wherein each rod has a stop that limits the travel of the moveable handle away from the stable handle.

8. A hand operated clamp comprising:

a stable handle, the stable handle having a post portion at a first end thereof that carries a first foam grip;

a pair of parallel rods secured to and extending outward from the stable handle;

a moveable handle that is moveable across the parallel rods, the moveable handle having (i) at least one threaded hole positioned adjacent a corresponding one of the parallel rods, and (ii) a second post portion at a first end of the moveable handle; and (iii) a second foam grip carried by the second post portion, the first and second foam grips being positioned opposite one another to facilitate gripping an item there between when the moveable handle is pulled towards the stable handle;

first and second coil springs arranged in series and positioned about a first one of the parallel rods, the first and second coil springs having different spring constants and being arranged to bias the moveable handle away from the stable handle;

third and fourth coil springs arranged in series and positioned about a second one of the parallel rods, the third and fourth coil springs having different spring constants and being arranged to bias the moveable handle away from the stable handle;

a threaded locking screw that threadably engages a selected one of the threaded holes, wherein a distal end of the threaded locking screw is arranged to engage the rod corresponding to the engaged threaded hole to provide a friction lock that holds the moveable handle in place relative to the rods when the threaded locking screw is screwed sufficiently into the selected threaded hole; and wherein, the hand operated clamp is configured to be held by a user using a single hand with a thumb engaging one of the handles and one or more fingers engaging the other handle to facilitate use, whereby the moveable handle can be drawn towards the stable handle by pulling the thumb and fingers together thereby facilitate clamping an object between the first and second grip features.

9. A hand operated clamp as recited in claim 8 further comprising a cap on each rod that serves as a stop to limits the travel of the moveable handle away from the stable handle.

10. A hand operated clamp comprising:

a stable handle, the stable handle having a first grip feature at a first end of the stable handle;

a pair of parallel rods secured to and extending outward from the stable handle;

a moveable handle that is moveable across the parallel rods, the moveable handle having a second grip feature at a first end of the moveable handle, the first and second grip features being positioned opposite one another to facilitate gripping an item there between when the moveable handle is pulled towards the stable handle;

a first coil spring arrangement positioned about the first rod and arranged engage the stable and moveable handles to bias the moveable handle away from the stable handle;

a second coil spring arrangement positioned about the second rod and arranged engage the stable and moveable handles to further bias the moveable handle away from the stable handle; and a locking mechanism carried on the moveable handle and arranged to engage one of the rods when locked to hold the moveable handle in place relative to the rods; and wherein each coil spring arrangement includes a first coil spring and a second coil spring arranged in series about their corresponding rod, wherein the first coil spring has a higher spring constant than the second coil spring.

11. A hand operated clamp as recited in claim 10 wherein:

the moving handle has a first threaded hole positioned adjacent one of the parallel rods; and the locking mechanism is a threaded locking screw that threadably engages the threaded hole, and wherein a distal end of the threaded locking screw is arranged to engage the rod to provide a friction lock that holds the moveable handle in place relative to the rods when the threaded locking screw is screwed sufficiently into the first threaded hole.

12. A hand operated clamp as recited in claim 10 wherein:

the moving handle has a first threaded hole positioned adjacent one of the parallel rods; and the locking mechanism is a threaded locking screw that threadably engages the threaded hole, and wherein a distal end of the threaded locking screw is arranged to engage the rod to provide a friction lock that holds the moveable handle in place relative to the rods when the threaded locking screw is screwed sufficiently into the first threaded hole.

13. A hand operated clamp as recited in claim 10 wherein the hand operated clamp is configured to be held by a user using a single hand with a thumb engaging one of the handles and one or more fingers engaging the other handle to facilitate use, whereby the moveable handle can be drawn towards the stable handle by pulling the thumb and fingers together thereby facilitate clamping an object between the first and second grip features.

14. A hand operated clamp as recited in claim 10 wherein the grip features are formed from foam.

15. A hand operated clamp as recited in claim 10 wherein the first end of each handle includes a post portion and each grip feature is carried by the post portion of the grip feature's corresponding handle.

16. A hand operated clamp as recited in claim 10 further comprising a cap on each rod that serves as a stop to limits the travel of the moveable handle away from the stable handle.

* * * * *